US007733336B2

(12) United States Patent
Lim

(10) Patent No.: US 7,733,336 B2
(45) Date of Patent: Jun. 8, 2010

(54) LIQUID CRYSTAL DISPLAY DEVICE AND METHOD OF DRIVING THE SAME

(75) Inventor: Kyoung-Moon Lim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 733 days.

(21) Appl. No.: 11/638,514

(22) Filed: Dec. 14, 2006

(65) Prior Publication Data

US 2008/0001909 A1 Jan. 3, 2008

(30) Foreign Application Priority Data

Jun. 30, 2006 (KR) ..... 10-2006-0060919

(51) Int. Cl.
*G09G 5/00* (2006.01)
*G09G 3/36* (2006.01)

(52) U.S. Cl. ..... 345/207; 345/102

(58) Field of Classification Search ..... 345/87–92, 345/102, 207; 348/602; 257/124, 228, 257, 257/290–293, 414, 461; 250/208.1–208.4, 250/214 AL See application file for complete search history.

(56) References Cited

U.S. PATENT DOCUMENTS 6,043,478 A * 3/2000 Wang ..... 250/208.1
6,043,479 A * 3/2000 Chiang ..... 250/208.1
6,087,703 A * 7/2000 Ohta et al. ..... 257/461
6,781,169 B2 * 8/2004 Roy ..... 257/292
6,975,008 B2 * 12/2005 Cok ..... 257/414
6,984,817 B2 * 1/2006 Cazaux ..... 250/214.1
7,435,935 B2 * 10/2008 Hirotsu et al. ..... 250/208.1
2005/0168428 A1 * 8/2005 Nakajima et al. ..... 345/99
2006/0007097 A1 * 1/2006 Ichikawa ..... 345/102
2006/0077169 A1 * 4/2006 Fujikawa ..... 345/102
2006/0284824 A1 * 12/2006 Yeh ..... 345/102
2008/0001910 A1 * 1/2008 Lim ..... 345/102

FOREIGN PATENT DOCUMENTS

JP 2004-281922 A 10/2004

* cited by examiner

*Primary Examiner*—Sumati Lefkowitz
*Assistant Examiner*—Rodney Amadiz
(74) *Attorney, Agent, or Firm*—Holland & Knight LLP

(57) ABSTRACT

A liquid crystal display device includes a liquid crystal panel, a backlight unit supplying light to the liquid crystal panel, a photo sensor detecting a brightness of an ambient surrounding the liquid crystal panel and generating a sense signal, and a signal processor adjusting a luminance of the light supplied by the backlight unit according to the sense signal.

15 Claims, 5 Drawing Sheets

LIQUID CRYSTAL DISPLAY DEVICE AND METHOD OF DRIVING THE SAME

The invention claims the benefit of Korean Patent Application No. 2006-0060919 filed in Korea on Jun. 30, 2006, which is hereby incorporated by reference in its entirety.

BACKGROUND OF THE INVENTION

1. Field of the Invention

Embodiments of the invention relates to a display device, and more particularly, to a liquid crystal display device and a method of driving the same. Although embodiments of the invention are suitable for a wide scope of applications, they are particularly suitable for obtaining a liquid crystal display device having a backlight unit that automatically adjusts according to ambient brightness and a method of driving the same.

2. Discussion of the Related Art

Recently, a display device has become thinner with larger display area as an industrial utilization increases. Among the various types of flat panel display ("FPD") devices, liquid crystal display ("LCD") devices and plasma display panel ("PDP") devices are widely used.

A PDP device is an self-emissive type display device where light is emitted from plasma of fluorescent materials in a sidewall between two substrates according to an applied voltage. In contrast, an LCD device is a non-emissive type display device where images are displayed by adjusting light from a backlight unit with a liquid crystal layer as a shutter. Since grey levels are displayed by a digital voltage in a PDP device, the PDP device has a disadvantage in displaying natural images. On the contrary, since an analog voltage is applied to both sides of a liquid crystal layer in an LCD device, the LCD device displays a natural image as compared with a PDP device.

Among LCD devices, an active matrix liquid crystal display ("AMLCD") device is widely used. In an AMLCD device, a thin film transistor ("TFT") is connected to a pixel and adjusts a voltage level of the pixel as a switching element to change light transmittance of the pixel and display images.

FIG. 1 is a block diagram showing a liquid crystal display device according to the related art. In FIG. 1, a liquid crystal display ("LCD") device includes a liquid crystal panel 1, a gate driver 4, a data driver 6, a timing controller 7, a backlight unit 8 and a source voltage generator 9. The liquid crystal panel 1 includes a plurality of thin film transistors (not shown) disposed in a matrix thereon. The gate driver 4 controls input of a data signal into the liquid crystal panel 1, and the data driver 6 inputs the data signal to the liquid crystal panel 1. The timing controller 7 controls a timing of the gate driver 4 and the data driver 6.

The backlight unit 8 is disposed under and supplies light to the liquid crystal panel 1. Further, the backlight unit 8 includes a backlight lamp 8*a* emitting light and a backlight driver 8*b* controlling the backlight lamp 8*a*. The source voltage generator 9 supplies source voltages to the gate driver 4, the data driver 6, the timing controller 7 and the backlight unit 8. The source voltage generator 9 is formed on a printed circuit board ("PCB"). Although not shown, the backlight lamp 8*a* includes one of at least one fluorescent lamp and a plurality of light emitting diodes ("LEDs").

Each of the thin film transistors ("TFTs") uses hydrogenated amorphous silicon ("a-Si:H") in a semiconductor layer. Hydrogenated amorphous silicon yields higher productivity while easily fabricated on a large sized substrate. In addition, since hydrogenated amorphous silicon is deposited at a temperature less than about 350° C., a glass substrate of low cost can be used. Accordingly, hydrogenated amorphous silicon is used mainly in a TFT, which is referred to as an amorphous silicon thin film transistor ("a-Si TFT").

However, since hydrogenated amorphous silicon has a disordered atomic arrangement, weak silicon-silicon ("Si—Si") bonds and dangling bonds exist in hydrogenated amorphous silicon. These types of bonds become metastable when light or an electric field is applied to hydrogenated amorphous silicon. As a result, such metastability makes the TFT unstable. Specifically, electric characteristics of hydrogenated amorphous silicon are degraded due to light irradiation. Furthermore, a TFT using hydrogenated amorphous silicon is difficult to be implemented in a driving circuit due to degraded electric characteristics such as a low field effect mobility between about 0.1 $cm^2$/Vsec to about 1.0 $cm^2$/Vsec, and poor reliability.

Accordingly, the substrate including a-Si TFTs is connected to a printed circuit board ("PCB") using a tape carrier package ("TCP") that has a driving integrated circuit ("IC"). The driving IC and its packaging increase production cost of the LCD device. Additionally, as the resolution of a liquid crystal panel for an LCD device increases, a pad pitch between gate pads or between data pads of the substrate including the a-Si TFT becomes smaller. Thus, bonding between the TCP and the substrate including the a-Si TFT becomes harder.

To solve these problems, a polycrystalline silicon thin film transistor ("p-Si TFT") is suggested. Due to a higher field effect mobility of a p-Si TFT as compared to an a-Si TFT, a driving circuit can be integrated on a substrate including the p-Si TFT, such that a driving element and a switching element are simultaneously formed. Accordingly, the TCP is not needed and the production cost is reduced. Moreover, a driving system may be integrated in the liquid crystal panel, and an LCD device where a driving system is integrated in a liquid crystal panel may be referred to a system on panel ("SOP") type LCD device.

FIG. 2 is a block diagram showing a liquid crystal display device using a polycrystalline silicon thin film transistor according to the related art. In FIG. 2, a liquid crystal display ("LCD") device includes a liquid crystal panel 10 having a liquid crystal layer interposed between two substrates. The liquid crystal panel 10 includes a display area 12 for displaying images and a non-display area 13 defined therein. A gate line "GL" and a data line "DL" crossing each other are formed in the display area 12. In addition, a thin film transistor ("TFT") "T" is connected to the gate line "GL" and the data line "DL."

A gate driver 14 and a data driver 16 are formed in the non-display area 13. The gate driver 14 and the data driver 16 respectively receive a gate signal and a data signal from an exterior system (not shown) and control the TFT "T" in the display area 12 through the gate line "GL" and the data line "DL," thereby changing light transmittance of the liquid crystal layer. Even though not shown in FIG. 2, a timing controller and a source voltage generator are formed on a printed circuit board ("PCB) and connected to the liquid crystal panel 10. Moreover, a backlight unit is disposed under the liquid crystal panel 10.

Since a backlight unit of an LCD device emits light of constant intensity, a display quality of the LCD device is deteriorated according to ambient brightness. When the backlight unit emits light of relatively low intensity, images displayed in the LCD device are rarely recognized under a circumstance of high ambient brightness. In addition, when the backlight unit emits light of relatively high intensity, power is wasted under a circumstance of low ambient brightness because light of relatively low intensity is enough to display recognizable images.

SUMMARY OF THE INVENTION

Accordingly, embodiments of the invention is directed to a liquid crystal display device and a method of driving the same that substantially obviate one or more of the problems due to limitations and disadvantages of the related art.

An object of embodiments of the invention is to provide a liquid crystal display device including a backlight unit automatically adjusted according to ambient brightness and a method of driving the same.

Another object of embodiments of the invention is to provide a liquid crystal display device that has improved display brightness and contrast ratio under a bright ambient luminance and a method of driving the same.

Another object of embodiments of the invention is to provide a liquid crystal display device that reduces power consumption under a dark ambient luminance and a method of driving the same.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a liquid crystal display device includes a liquid crystal panel, a backlight unit supplying light to the liquid crystal panel, a photo sensor detecting a brightness of ambient surrounding the liquid crystal panel and generating a sense signal, and a signal processor adjusting a luminance of the light supplied by the backlight unit according to the sense signal.

In another aspect, a method of driving a liquid crystal display device includes detecting a brightness of ambient surrounding a liquid crystal panel and generating a current type sense signal, converting the current type sense signal into a voltage type sense signal, and adjusting a brightness of a light supplied to the liquid crystal panel according to the voltage type sense signal.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
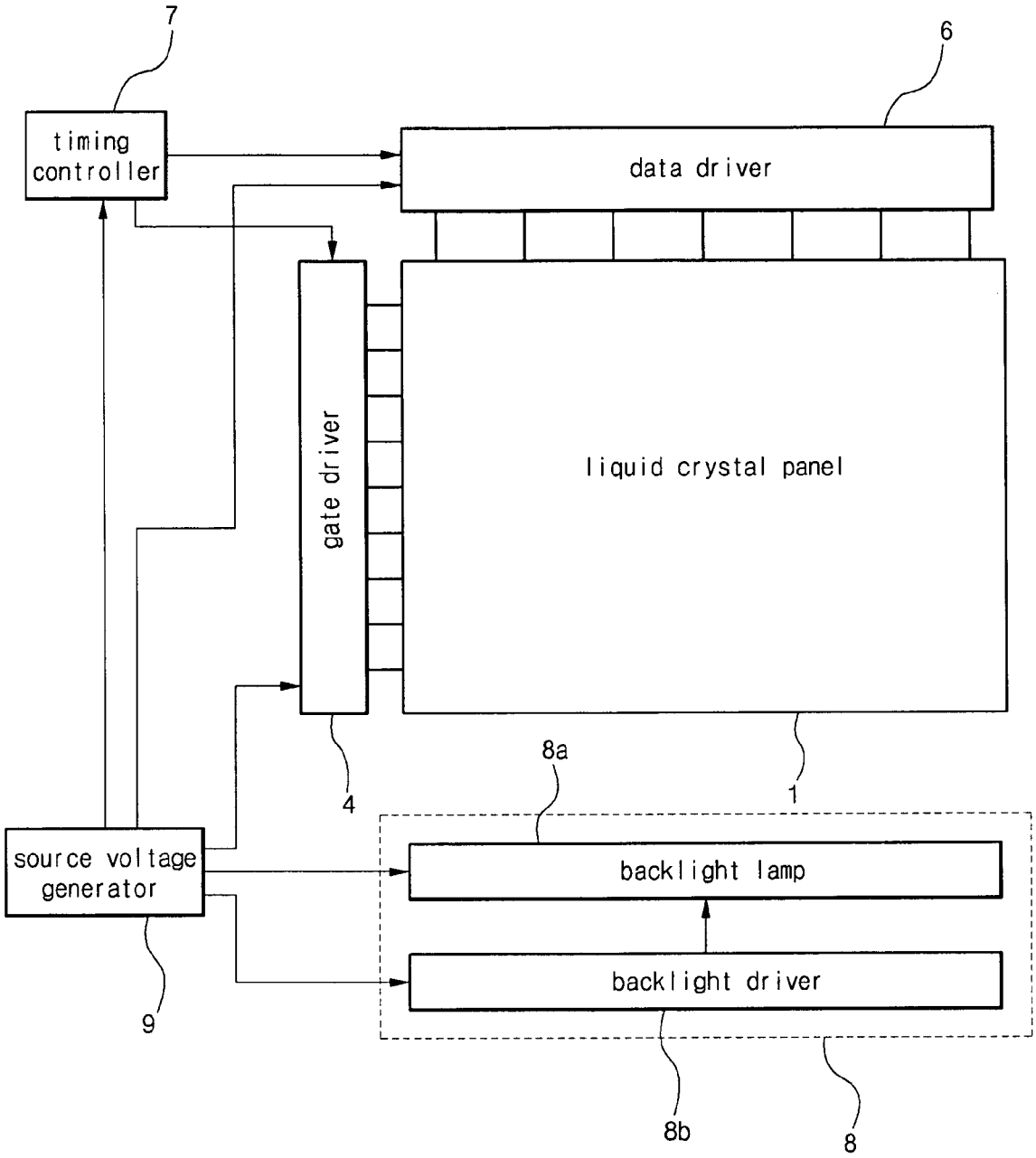
(related art) FIG. 1
FIG. 1 is a block diagram showing a liquid crystal display device according to the related art.
Figure 2:
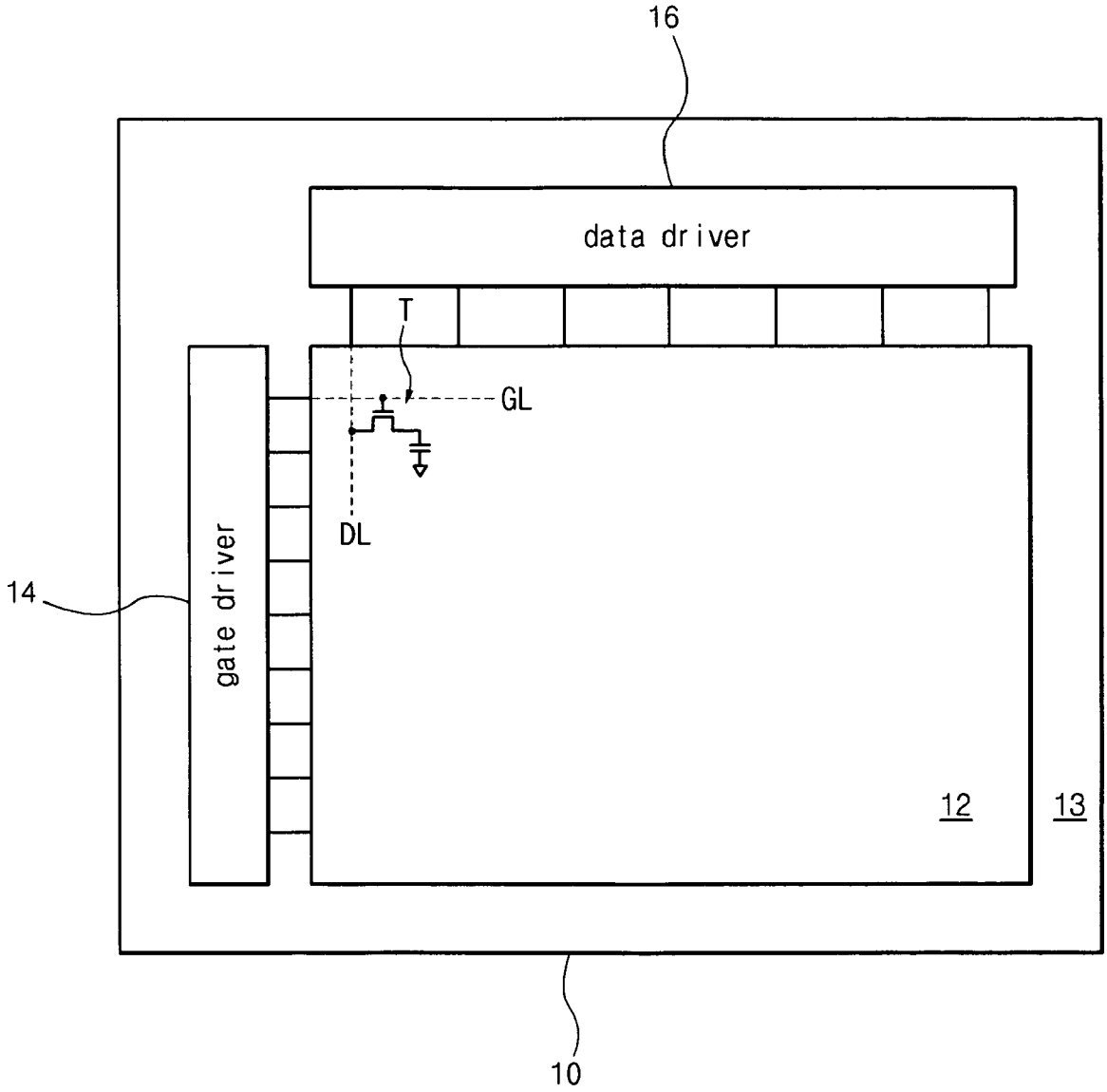
(related art) FIG. 2
FIG. 2 is a block diagram showing a liquid crystal display device using a polycrystalline silicon thin film transistor according to the related art.
Figure 3:
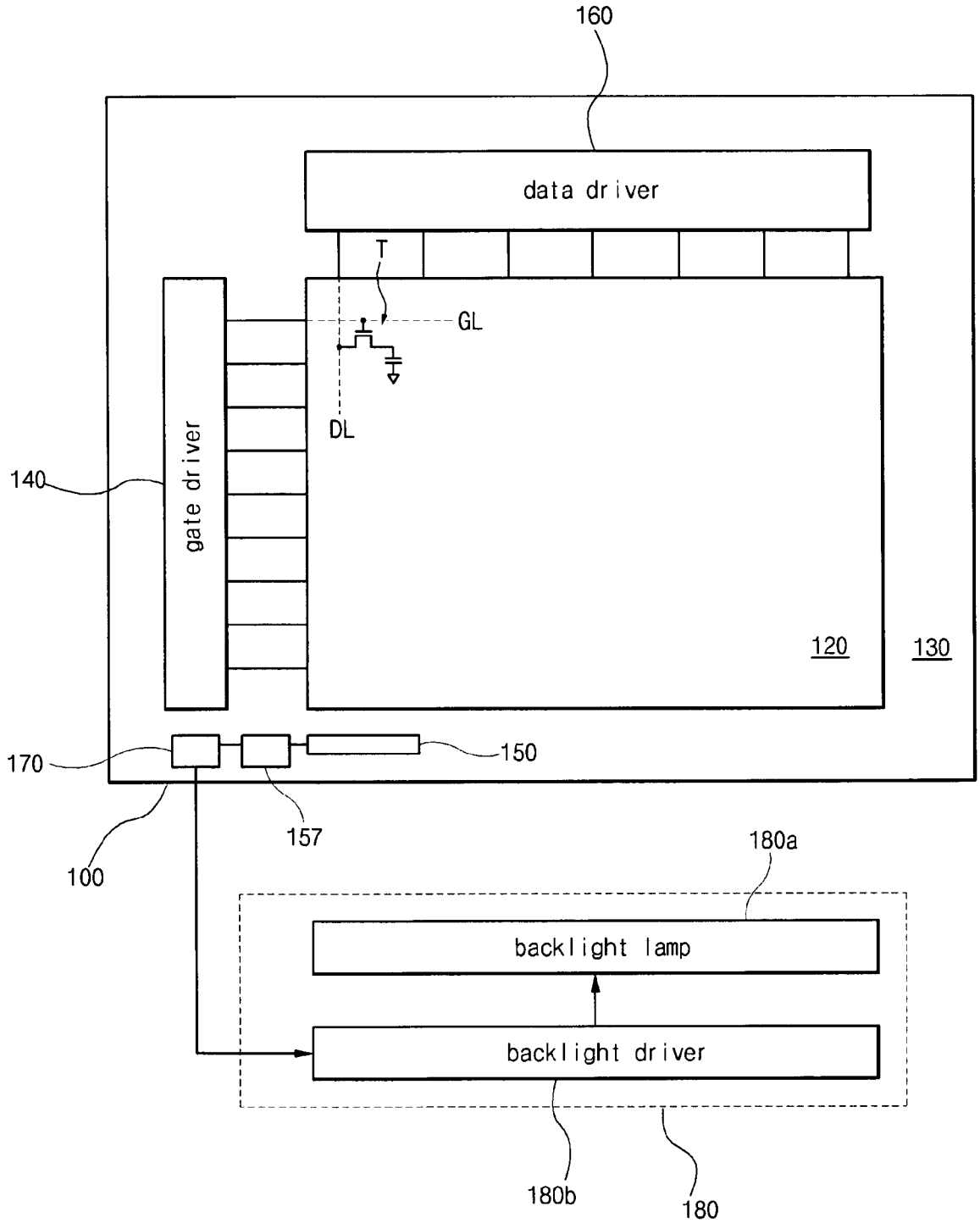
FIG. 3 is a schematic block diagram showing a liquid crystal display device according to an embodiment of the invention.

FIG. 3 is a schematic block diagram showing a liquid crystal display device according to an embodiment of the invention. In FIG. 3, a liquid crystal display ("LCD") device includes a liquid crystal panel 100 and a backlight unit 180. The liquid crystal panel 100 includes first and second substrates (not shown) and a liquid crystal layer between the first and second substrates. A display area 120 and a non-display area 130 at a periphery of the display area 120 are defined in the liquid crystal panel 100. A gate line "GL" and a data line "DL" crossing each other are formed in the display area 102 on the first substrate, and a thin film transistor "T" is connected to the gate line "GL" and the data line "DL." In addition, a gate driver 140, a data driver 160, a photo sensor 150, a sensor controller 157 and a signal processor 170 are formed in the non-display area 130 on the first substrate. The gate driver 140 controls input of a data signal into the TFT "T" using a gate signal from an external system, and the data driver 160 inputs the data signal to the TFT "T."

The backlight unit 180 including a backlight lamp 180*a* and a backlight driver 180*b* is disposed under and supplies light to the liquid crystal panel 100. The backlight lamp 180*a* emits the light and the backlight driver 180*b* controls the backlight lamp 180*a*. The backlight lamp 180*a* may include one of at least one fluorescent lamp and a plurality of light emitting diodes (LEDs). Although not shown in FIG. 3, the LCD device further includes a timing controller controlling a timing of the gate driver 140 and the data driver 160 and a source voltage generator supplying source voltages to the timing controller, the gate driver 140, the data driver and the backlight unit 180. The timing controller and the source voltage generator may be formed on a printed circuit board (PCB) including the external system.

The photo sensor 150 may be disposed at one of the display area 120, the non-display area 130 and a boarder portion of the display area 120 and the non-display area 130. The photo sensor 150 detects ambient brightness and generates a sense signal corresponding to the ambient brightness. For example, the photo sensor 150 may include one of a photo diode and a photo transistor where a portion sensing light is formed of amorphous silicon and the other portion is formed of polycrystalline silicon. The sensor controller 157 connected between the photo sensor 150 and the signal processor 170 converts a current type of the sense signal into a voltage type. Subsequently, the signal processor 170 connected to the sensor controller 157 converts the sense signal into a control signal. In addition, the signal processor 170 is connected to the backlight driver 180*b* of the backlight unit 180. Thus, the backlight driver 180*b* generates driving signals for the backlight lamp 180*a* in accordance with the control signal generated by the signal processor 170.

In the LCD device according to an embodiment of the invention, the photo sensor 150, the sensor controller 157 and the signal processor 170 may be formed through the same fabrication process as the TFT "T." Further, the sensor controller 157 and the signal processor 170 may include TFTs of polycrystalline silicon.

An exemplary operation of the LCD device according to an embodiment of the invention will be illustrated hereinafter. The liquid crystal panel 100 displays images by changing light transmittance of the liquid crystal layer due to the switching operation of the TFT "T." The gate driver 140 receives a gate control signal from the timing controller (not shown) and generates a gate signal. The gate signal is transmitted to the TFT through the gate line "GL." The data driver 160 receives a data control signal and an image signal of a digital type, and converts the image signal of a digital type into a data signal of an analog type. The data signal is transmitted to the TFT through the data line "DL."

The photo sensor 150 detects brightness and luminance of environment, i.e., ambient brightness of the liquid crystal panel 100, and generates a sense signal of a current type corresponding to the brightness and the luminance of environment. The sense signal having a current analog type then is transmitted to the sensor controller 157. The sensor controller 157 converts the current analog type sense signal into a voltage analog type sense signal, and the voltage analog type sense signal then is transmitted to the signal processor 170. The signal processor 170 converts the voltage analog type sense signal into a voltage digital type sense signal. In addition, the signal processor 170 outputs a control signal according to the voltage digital type sense signal, and the control signal is transmitted to the backlight driver 180*b* of the backlight unit 180.

The backlight driver 180*b* adjusts luminance of the backlight lamp 180*a* according to the control signal, and the backlight lamp 180*a* emits adjusted light to the liquid crystal panel 100. As a result, the TFT "T" is turned on/off according to the gate signal from the gate driver 140 and the data signal from the data driver 160, and the light transmittance of the liquid crystal layer is changed according to the data signal, thereby displaying images. When the ambient brightness is higher than a reference brightness, the backlight driver 180*b* supplies a high level voltage to the backlight lamp 180*a* and the backlight lamp 180*a* emits light of a high level luminance. Accordingly, deterioration of the LCD device in brightness and contrast ratio due to the high level ambient brightness is prevented. In addition, when the ambient brightness is lower than the reference brightness, the backlight driver 180*b* supplies a low level voltage to the backlight lamp 180*a* and the backlight lamp 180*a* emits light of a low level luminance. Accordingly, unnecessary power consumption under a circumstance of the low level ambient brightness is prevented.

Figure 4A:
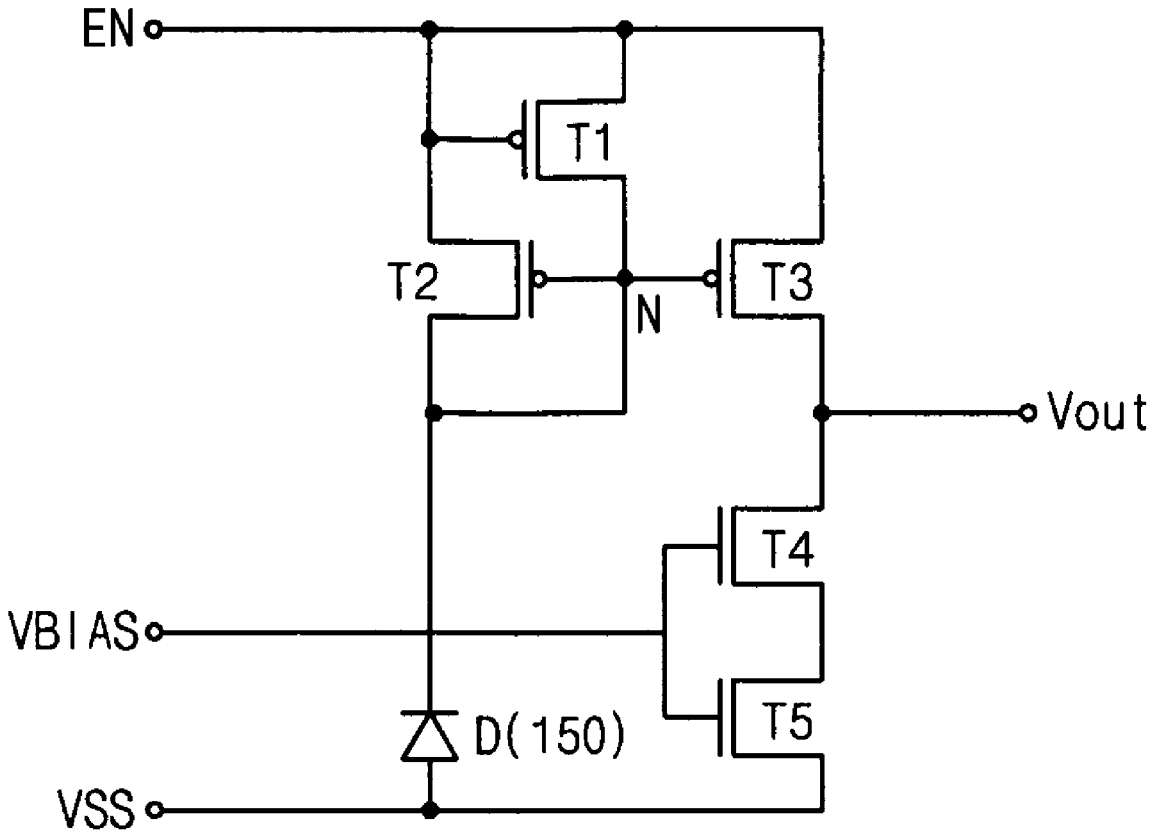
FIGS. 4A, 4B and 4C are schematic circuit diagrams respectively showing a sensor controller of a liquid crystal display device according to embodiments of the invention.
Figure 4B:
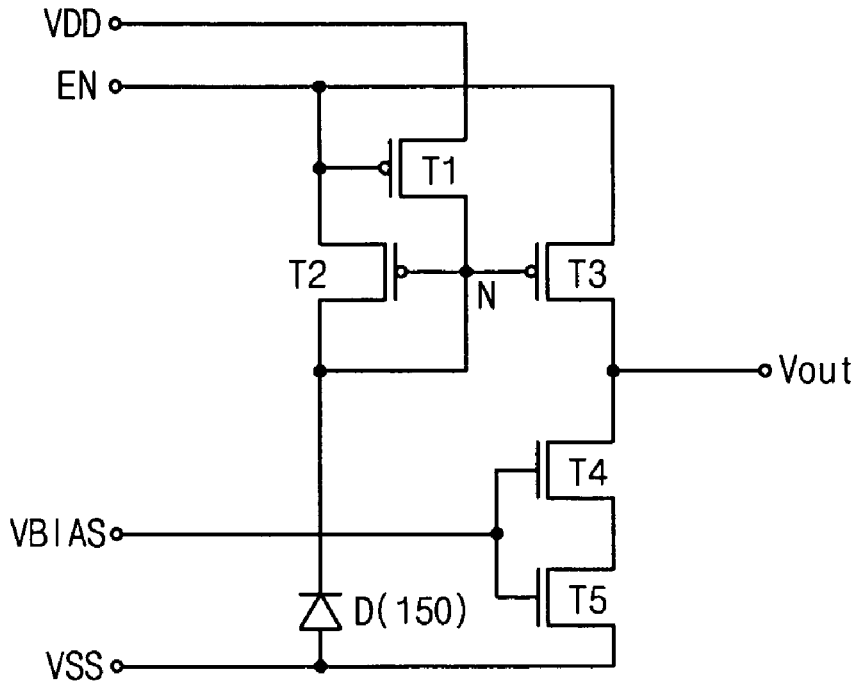
Figure 4C:
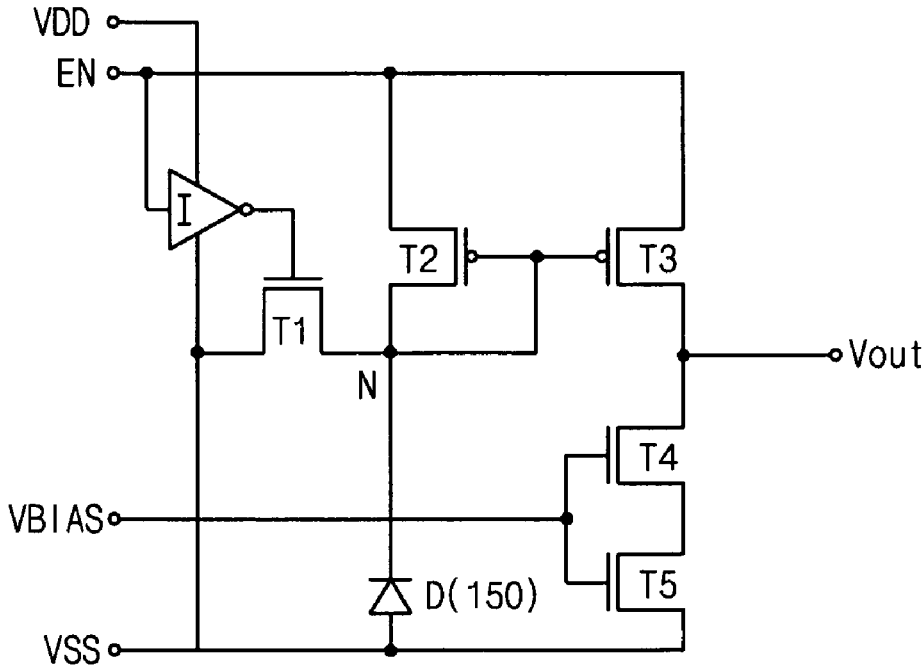

FIGS. 4A, 4B and 4C are schematic circuit diagrams respectively showing a sensor controller of a liquid crystal display device according to embodiments of the invention. In FIGS. 4A, 4B and 4C, a photo diode "D" is shown representing the photo sensor 150 in FIG. 3.

In FIG. 4A, a sensor controller includes first to fifth thin film transistors (TFTs) "T1" to "T5," and an enable signal, a variable signal, and a ground signal are supplied to the sensor controller. The first TFT "T1" transmits the enable signal to a node "N." The photo diode "D" adjusts a current passing through the node "N" according to ambient brightness of a liquid crystal panel, thereby adjusting a node voltage of the node "N." The second and third TFTs "T2" and "T3" are turned on/off according to the node voltage of the node "N," and the sensor controller outputs the enable signal when the third TFT "T3" is turned on. The fourth and fifth TFTs "T4" and "T5" function as a variable element, such as a variable resistor. Although not shown, a single TFT may be substituted for the fourth and fifth TFTs "T4" and "T5."

The first to third TFTs "T1" to "T3" are positive (P) type transistors, and the fourth and fifth TFTs "T4" and "T5" are negative (N) type transistors. In addition, each of the first to fifth TFTs "T1" to "T5" has a gate electrode, a source electrode and a drain electrode. The gate and source electrodes of the first TFT "T1" are connected to an enable signal input terminal "EN," and the drain electrode of the first TFT "T1" is connected to the node "N." The gate and drain electrodes of the second TFT "T2" are connected to the node "N," and the source electrode of the second TFT "T2" is connected to the enable signal input terminal "EN." The gate electrode of the third TFT "T3" is connected to the node "N," the source electrode of the third TFT "T3" is connected to the enable signal input terminal "EN," and the drain electrode of the third TFT "T3" is connected to an output terminal "Vout" of the sensor controller.

The gate electrode of the fourth TFT "T4" is connected to a variable signal input terminal "VBIAS," and the drain electrode of the fourth TFT "T4" is connected to the output terminal "Vout." The gate electrode of the fifth TFT "T5" is connected to the variable signal input terminal "VBIAS," the drain electrode of the fifth TFT "T5" is connected to a ground terminal "VSS," and the drain electrode of the fifth TFT "T5" connected to the source electrode of the fourth TFT "T4." The photo diode "D" as a photo sensor 150 (of FIG. 3) has an anode connected to the ground terminal "VSS" and a cathode connected to the node "N."

An operation of a sensor controller of an LCD device according to an embodiment of the invention will be illustrated hereinafter. When the enable signal of a high level voltage is applied to the sensor controller 157 (of FIG. 3) and light is irradiated on the photo diode "D." Current flowing from the anode to the cathode is generated in the photo diode "D," and a node voltage of the node "N" is reduced because the node "N" is electrically short-circuited to the ground terminal "VSS" due to the current generated in the photo diode "D." Since the reduced node voltage of the node "N" is applied to the gate electrodes of the second and third TFTs "T2" and "T3," the second and third TFTs "T2" and "T3" are turned on when the reduced node voltage of the node "N" is lower than a threshold voltage of the second and third TFTs "T2" and "T3." As a result, an output voltage corresponding to the reduced node voltage of the node "N" is outputted through the output terminal "Vout" of the sensor controller. Since the output voltage corresponds to the reduced node voltage and the reduced node voltage corresponds to the current generated in the photo diode "D," the output voltage corresponding to the current generated in the photo diode "D" is outputted to the signal processor 170 (of FIG. 3). Magnitude of the output voltage of the output terminal "Vout" may be adjusted by the variable signal. The variable signal controls on/off states of the fourth and fifth TFTs "T4" and "T5" and a current flowing through the fourth and fifth TFTs "T4" and "T5" is controlled by the on/off states. When the third, fourth and fifth TFTs "T3," "T4" and "T5" are partially turned on, the output voltage is determined by a voltage distribution law. Accordingly, the magnitude of the output voltage is adjusted by the states of the fourth and fifth TFTs "T4" and "T5," thereby adjusting the magnitude of the output voltage by the variable signal.

When the enable signal of a low level voltage is applied to the sensor controller 157 (of FIG. 3), the first TFT "T1" is turned on and the node "N" is electrically short-circuited to the enable signal input terminal "EN." Accordingly, the node "N" has a node voltage corresponding to the enable signal of the enable signal input terminal "EN" and the second and third TFTs "T2" and "T3" are turned on. As a result, the output terminal "Vout" has an output voltage corresponding to the enable signal of the enable signal input terminal "EN,"

i.e., a low level voltage. Even though a current is generated in the photo diode "D" due to light irradiated on the photo diode "D," the current may flow out to the enable signal input terminal "EN" through the turned-on first and second TFTs "T1" and "T2." Accordingly, when the enable signal of a low level voltage is applied to the sensor controller 157, the sensor controller 157 outputs a low level voltage and is not operated. Therefore, a current signal generated in a photo sensor according to ambient brightness is excellently converted into a voltage signal in sensor controller and reliability of the photo sensor is improved.

In FIG. 4B, a sensor controller includes first to fifth thin film transistors (TFTs) "T1" to "T5," and a source signal, an enable signal, a variable signal and a ground signal are supplied to the sensor controller. The first TFT "T1" transmits the source signal to a node "N." The photo diode "D" adjusts a current passing through the node "N" according to ambient brightness of a liquid crystal panel, thereby adjusting a node voltage of the node "N." The second and third TFTs "T2" and "T3" are turned on/off according to the node voltage of the node "N," and the sensor controller outputs the enable signal when the third TFT "T3" is turned on. The fourth and fifth TFTs "T4" and "T5" function as a variable element such as a variable resistor. Although not shown, a single TFT may be substituted for the fourth and fifth TFTs "T4" and "T5."

The first to third TFTs "T1" to "T3" are positive (P) type transistors, and the fourth and fifth TFTs "T4" and "T5" are negative (N) type transistors. In addition, each of the first to fifth TFTs"T1" to "T5" has a gate electrode, a source electrode and a drain electrode. The gate electrode of the first TFT "T1" is connected to an enable signal input terminal "EN," the source electrode of the first TFT "T1" is connected to a source terminal "VDD," and the drain electrode of the first TFT "T1" is connected to the node "N." The gate and drain electrodes of the second TFT "T2" are connected to the node "N," and the source electrode of the second TFT "T2" is connected to the enable signal input terminal "EN." The gate electrode of the third TFT "T3" is connected to the node "N," the source electrode of the third TFT "T3" is connected to the enable signal input terminal "EN," and the drain electrode of the third TFT "T3" is connected to an output terminal "Vout" of the sensor controller.

The gate electrode of the fourth TFT "T4" is connected to a variable signal input terminal "VBIAS," and the drain electrode of the fourth TFT "T4" is connected to the output terminal "Vout." The gate electrode of the fifth TFT "T5" is connected to the variable signal input terminal "VBIAS," the drain electrode of the fifth TFT "T5" is connected to a ground terminal "VSS," and the drain electrode of the fifth TFT "T5" connected to the source electrode of the fourth TFT "T4." The photo diode "D" as a photo sensor 150 (of FIG. 3) has an anode connected to the ground terminal "VSS" and a cathode connected to the node "N."

An exemplary operation of a sensor controller of an LCD device according to an embodiment of the invention will be illustrated hereinafter. When the enable signal of a high level voltage is applied to the sensor controller 157 (of FIG. 3) and light is irradiated on the photo diode "D," a current flowing from the anode to the cathode is generated in the photo diode "D" and a node voltage of the node "N" is reduced because the node "N" is electrically short-circuited to the ground terminal "VSS" due to the current generated in the photo diode "D." Since the reduced node voltage of the node "N" is applied to the gate electrodes of the second and third TFTs "T2" and "T3,"the second and third TFTs "T2" and "T3" are turned on when the reduced node voltage of the node "N" is lower than a threshold voltage of the second and third TFTs "T2" and "T3." As a result, an output voltage corresponding to the reduced node voltage of the node "N" is outputted through the output terminal "Vout." Since the output voltage corresponds to the reduced node voltage and the reduced node voltage corresponds to the current generated in the photo diode "D," the output voltage corresponding to the current generated in the photo diode "D" is outputted. Magnitude of the output voltage of the output terminal "Vout" may be adjusted by the variable signal. The variable signal controls on/off states of the fourth and fifth TFTs "T4" and "T5" and a current flowing through the fourth and fifth TFTs "T4" and "T5" is controlled by the on/off states. Accordingly, the magnitude of the output voltage is adjusted by the states of the fourth and fifth TFTs "T4" and "T5," thereby adjusting the magnitude of the output voltage by the variable signal.

When the enable signal of a low level voltage is applied to the sensor controller 157 (of FIG. 3), the first TFT "T1" is turned on and the node "N" is electrically short-circuited to the source terminal "VDD." Accordingly, the node "N" has a node voltage corresponding to the source signal of the source terminal "VDD." Since the source signal has a high level voltage, the second and third TFTs "T2" and "T3" are turned off. As a result, an output terminal "Vout" has an output voltage corresponding to the ground signal of the ground terminal "VSS," i.e., a low level voltage. Even though a current is generated in the photo diode "D" due to light irradiated on the photo diode "D," the current may flow out to the source terminal "VDD" through the turned-on first TFT "T1." Accordingly, when the enable signal of a low level voltage is applied to the sensor controller 157, the sensor controller 157 outputs a low level voltage and is not operated. Therefore, a current signal generated in a photo sensor according to ambient brightness is excellently converted into a voltage signal in sensor controller and reliability of the photo sensor is improved.

In FIG. 4C, a sensor controller includes first to fifth thin film transistors (TFTs) "T1" to "T5" and an inverter "I," and a source signal, an enable signal, a variable signal and a ground signal are supplied to the sensor controller. The first TFT "T1" transmits the source signal to a node "N." The photo diode "D" adjusts a current passing through the node "N" according to ambient brightness of a liquid crystal panel, thereby adjusting a node voltage of the node "N." The second and third TFTs "T2" and "T3" are turned on/off according to the node voltage of the node "N," and the sensor controller outputs the enable signal when the third TFT "T3" is turned on. The fourth and fifth TFTs "T4" and "T5" function as a variable element such as a variable resistor. Although not shown, a single TFT may be substituted for the fourth and fifth TFTs "T4" and "T5."

The second and third TFTs "T2" and "T3" are positive (P) type transistors, and the first, fourth and fifth TFTs "T1," "T4" and "T5" are negative (N) type transistors. In addition, each of the first to fifth TFTs "T1" to "T5" has a gate electrode, a source electrode and a drain electrode. An input of the inverter "I" is connected to an enable signal input terminal "EN," and the source signal and the ground signal are supplied to the inverter "I" as a source power. The gate electrode of the first TFT "T1" is connected to an output of the inverter "I," the source electrode of the first TFT "T1" is connected to a ground terminal "VSS," and the drain electrode of the first TFT "T1" is connected to the node "N."

The gate and drain electrodes of the second TFT "T2" are connected to the node "N," and the source electrode of the second TFT "T2" is connected to an enable signal input terminal "EN." The gate electrode of the third TFT "T3" is connected to the node "N," the source electrode of the third TFT "T3" is connected to the enable signal input terminal "EN," and the drain electrode of the third TFT "T3" is connected to an output terminal "Vout" of the sensor controller. The gate electrode of the fourth TFT "T4" is connected to a variable signal input terminal "VBIAS," and the drain electrode of the fourth TFT "T4" is connected to the output terminal "Vout." The gate electrode of the fifth TFT "T5" is connected to the variable signal input terminal "VBIAS," the drain electrode of the fifth TFT "T5" is connected to a ground terminal "VSS," and the drain electrode of the fifth TFT "T5" connected to the source electrode of the fourth TFT "T4." The photo diode "D" as a photo sensor 150 (of FIG. 3) has an anode connected to the ground terminal "VSS" and a cathode connected to the node "N."

An exemplary operation of a sensor controller of an LCD device according to an embodiment of the invention will be illustrated hereinafter. When the enable signal of a high level voltage is applied to the sensor controller 157 (of FIG. 3) and light is irradiated on the photo diode "D," a current flowing from the anode to the cathode is generated in the photo diode "D" and a node voltage of the node "N" is reduced because the node "N" is electrically short-circuited to the ground terminal "VSS" due to the current generated in the photo diode "D." Since the reduced node voltage of the node "N" is applied to the gate electrodes of the second and third TFTs "T2" and "T3," the second and third TFTs "T2" and "T3" are turned on when the reduced node voltage of the node "N" is lower than a threshold voltage of the second and third TFTs "T2" and "T3." As a result, an output voltage corresponding to the reduced node voltage of the node "N" is outputted through the output terminal "Vout." Since the output voltage corresponds to the reduced node voltage and the reduced node voltage corresponds to the current generated in the photo diode "D," the output voltage corresponding to the current generated in the photo diode "D" is outputted. Magnitude of the output voltage of the output terminal "Vout" may be adjusted by the variable signal. The variable signal controls on/off states of the fourth and fifth TFTs "T4" and "T5" and a current flowing through the fourth and fifth TFTs "T4" and "T5" is controlled by the on/off states. Accordingly, the magnitude of the output voltage is adjusted by the states of the fourth and fifth TFTs "T4" and "T5," thereby adjusting the magnitude of the output voltage by the variable signal.

When the enable signal of a low level voltage is applied to the sensor controller 157 (of FIG. 3), the first TFT "T1" is turned on and the node "N" is electrically short-circuited to the ground terminal "VSS." Accordingly, the node "N" has a node voltage corresponding to the ground signal of the ground terminal "VSS." Since the ground signal has a low level voltage, the second and third TFTs "T2" and "T3" are turned on. As a result, an output terminal "Vout" has an output voltage corresponding to the enable signal of the enable signal input terminal "VSS," i.e., a low level voltage. Even though a current is generated in the photo diode "D" due to light irradiated on the photo diode "D," the current may flow out to the enable signal input terminal "EN" through the turned-on second TFT "T2." Accordingly, when the enable signal of a low level voltage is applied to the sensor controller 157, the sensor controller 157 outputs a low level voltage and is not operated. Therefore, a current signal generated in a photo sensor according to ambient brightness is excellently converted into a voltage signal in sensor controller and reliability of the photo sensor is improved.

Thus, in an LCD device according to an embodiment of the invention, display brightness and contrast ratio under a bright ambient luminance are improved and power consumption under a dark ambient luminance is reduced by adjusting a backlight unit according to the condition of ambient luminance. In addition, reliability in operation of a photo sensor is improved by using a sensor controller where a magnitude of output voltage is easily adjusted due to a variable signal.

It will be apparent to those skilled in the art that various modifications and variations can be made in the liquid crystal display device and the method of driving the same of embodiments of the invention without departing from the spirit or scope of the invention. Thus, it is intended that embodiments of the invention cover the modifications and variations of this invention provided they come within the scope of the appended claims and their equivalents.

What is claimed is:

1. A liquid crystal display device, comprising:

a liquid crystal panel;

a backlight unit supplying light to the liquid crystal panel;

a photo sensor detecting a brightness of an ambient surrounding the liquid crystal panel and generating a sense signal, wherein the sense signal generated by the photo sensor is a current type sense signal;

a signal processor adjusting a luminance of the light supplied by the backlight unit according to the sense signal; and a sensor controller converting the current type sense signal to a voltage type sense signal, wherein the sensor controller includes:

first to third thin film transistors each having a gate electrode, a source electrode and a drain electrode;

a variable element connected to the third thin film transistor;

an enable signal input terminal receiving an enable signal, the enable signal having one of high and low level voltages;

a ground terminal receiving a ground signal;

a variable signal input terminal applying a variable signal to the variable element; and an output terminal outputting an output voltage to the signal processor, wherein the photo sensor is connected to the ground terminal and the gate electrodes of the second and third thin film transistors.

2. The device according to claim 1, wherein the photo sensor, the sensor controller and the signal processor are formed in the liquid crystal panel, and wherein the sensor controller, the signal processor and the liquid crystal panel include a polycrystalline silicon element.

3. The device according to claim 1, wherein the liquid crystal panel includes a first substrate, a second substrate and a liquid crystal layer between the first and second substrates, and the photo sensor, sensor controller and the signal processor are formed on the first substrate.

4. The device according to claim 1, wherein the variable signal adjusts a magnitude of the voltage type sense signal.

5. The device according to claim 1, wherein the variable element includes a fourth thin film transistor connected to the third thin film transistor, and the variable signal is applied to a gate electrode of the fourth thin film transistor.

6. The device according to claim 1, wherein the variable element includes a fourth and fifth thin film transistors connected to the third thin film transistor in series, and the variable signal is applied to gate electrodes of the fourth and fifth thin film transistors.

7. The device according to claim 6, wherein the fourth and fifth thin film transistors include negative (N) type transistors.

8. The device according to claim 1, wherein the gate electrode and the source electrode of the first thin film transistor are connected to the enable signal input terminal and the drain electrode of the first thin film transistor is connected to the gate electrodes of the second and third thin film transistors to define a node, wherein the drain electrode of the second thin film transistor is connected to the node and the source electrode of the second thin film transistor is connected to the enable signal input terminal, and wherein the source electrode of the third thin film transistor is connected to the enable signal input terminal and the drain electrode of the third thin film transistor is connected to the output terminal.

9. The device according to claim 8, wherein the first to third thin film transistors include positive (P) type transistors.

10. The device according to claim 1, wherein the sensor controller further includes a source terminal receiving a source voltage, wherein the gate electrode of the first thin film transistor is connected to the enable signal input terminal, the source electrode of the first thin film transistor is connected to the source terminal and the drain electrode of the first thin film transistor is connected to the gate electrodes of the second and third thin film transistors to define a node, wherein the drain electrode of the second thin film transistor is connected to the node and the source electrode of the second thin film transistor is connected to the enable signal input terminal, and wherein the source electrode of the third thin film transistor is connected to the enable signal input terminal and the drain electrode of the third thin film transistor is connected to the output terminal.

11. The device according to claim 10, wherein the first to third thin film transistors include positive (P) type transistors.

12. The device according to claim 1, wherein the sensor controller further includes a source terminal receiving a source voltage and an inverter inverting the enable signal, wherein the gate electrode of the first thin film transistor is connected to the inverter, the source electrode of the first thin film transistor is connected to the source terminal and the drain electrode of the first thin film transistor is connected to the gate electrodes of the second and third thin film transistors to define a node, wherein the drain electrode of the second thin film transistor is connected to the node and the source electrode of the second thin film transistor is connected to the enable signal input terminal, and wherein the source electrode of the third thin film transistor is connected to the enable signal input terminal and the drain electrode of the third thin film transistor is connected to the output terminal.

13. The device according to claim 12, wherein the first thin film transistor includes a negative (N) type transistor, and the second and third thin film transistors include positive (P) type transistors.

14. A method of driving a liquid crystal display device, comprising:

detecting a brightness of an ambient surrounding a liquid crystal panel by a photo sensor and generating a current type sense signal;

converting the current type sense signal into a voltage type sense signal by using a sense controller, wherein the sensor controller includes:

first to third thin film transistors each having a gate electrode, a source electrode and a drain electrode;

a variable element connected to the third thin film transistor;

an enable signal input terminal receiving an enable signal, the enable signal having one of high and low level voltages;

a ground terminal receiving a ground signal;

a variable signal input terminal applying a variable signal to the variable element; and an output terminal outputting an output voltage to the signal processor, wherein the photo sensor is connected to the ground terminal and the gate electrodes of the second and third thin film transistors; and adjusting a brightness of a light supplied to the liquid crystal panel according to the voltage type sense signal.

15. The method according to claim 14, wherein the magnitude of the voltage type sense signal is adjusted by a variable signal.

* * * * *